US007493736B2

(12) United States Patent
Sanders

(10) Patent No.: US 7,493,736 B2
(45) Date of Patent: Feb. 24, 2009

(54) CONCRETE SLAB PROTECTOR

(75) Inventor: Mark E. Sanders, Zionsville, IN (US)

(73) Assignee: Sanders Corporation, Whitestown, IN (US)

( * ) Notice: Subject to any disclaimer, the term of this patent is extended or adjusted under 35 U.S.C. 154(b) by 1725 days.

(21) Appl. No.: 10/039,717

(22) Filed: Jan. 3, 2002

(65) Prior Publication Data

US 2003/0122053 A1 Jul. 3, 2003

(51) Int. Cl.
*E04F 13/00* (2006.01)
*E04F 19/00* (2006.01)
*E04F 21/00* (2006.01)

(52) U.S. Cl. ..... 52/741.3; 52/58; 52/506.01; 52/23; 52/745.06; 52/749.13; 52/408; 52/DIG. 12

(58) Field of Classification Search ..... 249/207, 249/112, 115; 52/249.13, 746.1, DIG. 12, 52/23, 58, 506.01, 741.3, 745.06, 749.13, 52/408; 2/455
See application file for complete search history.

(56) References Cited

U.S. PATENT DOCUMENTS 2,145,139 A * 1/1939 Scharfenberg ..... 2/46
3,729,765 A 5/1973 Peterson
3,916,447 A * 11/1975 Thompson ..... 2/46
RE29,945 E * 3/1979 Scott ..... 249/80
4,537,796 A 8/1985 Buyers et al.
4,595,168 A * 6/1986 Goodwin ..... 249/48
4,798,364 A 1/1989 Scott
4,964,176 A * 10/1990 Previdi ..... 2/242
5,119,933 A * 6/1992 Taylor ..... 206/232
5,363,619 A 11/1994 McPhee
5,502,941 A 4/1996 Zember et al.
5,540,524 A 7/1996 Gonsalves

FOREIGN PATENT DOCUMENTS

JP 5-71217 * 3/1993
JP 05071217 A * 3/1993
JP 6-129095 * 5/1994

* cited by examiner

*Primary Examiner*—Jeanette Chapman
(74) *Attorney, Agent, or Firm*—Maginot, Moore & Beck LLP

(57) ABSTRACT

A slab protector is provided in the form of a sheet of material configured to overlap an edge of a newly poured slab to protect that slab while an adjacent slab is poured and surface finished. The sheet of material extends along the entire length of the edge impacted by the adjacent pour and is configured to have an overhang portion that extends down over the exposed side of the slab. The sheet also includes a primary portion that overlays a significant portion of the surface of the poured slab. The slab protector sheet is preferably formed of a plastic material and includes an adhesive strip on its underside that removably and temporarily adheres the slab protector to the underlying concrete slab to resist dislodgement.

13 Claims, 2 Drawing Sheets

CONCRETE SLAB PROTECTOR

BACKGROUND OF THE INVENTION

The present invention relates to the pouring and preparation of concrete slabs. More specifically, the invention concerns a device for protecting a concrete slab during an adjacent pour.

The construction of concrete slabs for driveways, sidewalks and the like, is well known. In a typical construction, temporary forms are used to define the area into which the concrete is to be poured. The forms serve to contain the concrete mixture while it hardens and during subsequent treatment. When a large slab is to be poured, it is common to divide the slab into successive pours, due to the nature of the concrete material and the manpower available at the jobsite to complete the pour.

In some cases, the temporary forms, which are often in the form of wooden planks, are used to divide a larger area into distinct smaller regions. In other cases, a permanent screed rail can separate adjacent smaller regions for successive pours.

After a slab, whether large or small, has been poured, it must be physically treated or finished. This finishing can include floating and troweling to ensure a level concrete surface. For smaller slabs, such as a sidewalk, a hand trowel can be sufficient to level the poured surface or provide other finish treatments. For larger slabs, such as a driveway, a long-handled trowel can be used to perform the same function.

When a typical driveway is being constructed, a first slab is poured and finished, and before that first slab has dried an adjacent slab is poured and finished. Successive slabs are poured and treated as quickly as the available manpower permits. One difficulty that is encountered with this approach is that during the leveling process the trowel will frequently intrude onto a previously poured and finished slab. This intrusion can disrupt the surface of the previously poured slab, requiring re-finishing or leading to an undesirable surface defect in the slab.

This difficulty can be particularly problematic where the poured concrete slab is intended to have a decorative quality. In addition, the surface defect can be a starting point for more serious erosion of the slab. Consequently, there is a need for some means for protecting one poured surface from disruption by the pouring and treatment of an adjacent surface.

SUMMARY OF THE INVENTION

The present invention addressed this need by the provision of a slab protector in the form of a sheet of material configured to overlap an edge of the slab. The sheet of material extends along the entire length of the edge impacted by the adjacent pour. The sheet is configured to have an overhang portion that extends down over the exposed side of the slab. The sheet also includes a primary portion that overlays a significant portion of the surface of the poured slab.

In a preferred embodiment, the primary portion has a width measured inboard from the slab edge that is sufficient to account for a complete intrusion of a trowel, bull float or other surface finishing tool, onto the poured slab. In a specific embodiment, this width can be one to two feet. In addition, in the preferred embodiment, the overhang portion has a length extending down the exposed side of the slab that is approximately one-half the depth of the poured slab. Thus, in a specific embodiment for a typical driveway pour, the overhang portion can have a length of about two inches.

Preferably, the slab protector sheet can be formed of a material that is tear resistant and durable. In addition, the material is non-adherent to the concrete poured in the adjacent location. In certain embodiments, the sheet material is flexible so that it can be easily manipulated. A score or fold line can be provided on the flexible sheet at the joint between the primary portion and the overhang portion to facilitate folding the sheet at the job site. In other embodiments, the slab protector is relatively more rigid with the relationship between the overhang portion and the primary portion generally fixed.

Most preferably, the slab protector sheet is formed from a plastic material, such as a polyethylene or polyurethane. The slab protector can be provided as individual sheets having pre-determined dimensions for expected slab constructions. Alternatively, the slab protector can be cut from a roll of material, so that the sheet can be cut to size.

In some embodiments of the invention, the underside of the slab protector sheet is provided with some means for removably adhering the sheet to the poured slab. In these embodiments, this means can be provided as a strip of adherent material around the free perimeter of the primary portion. Most preferably, the overhand portion is not provided with a similar means for adhering. In the most preferred embodiment of this feature, the strip of adherent material is initially covered by a removable cover strip that protects the adherent material until the slab protector is ready for use.

One object of the invention is to provide a device for protecting a poured slab during pouring and surface treatment of an adjacent slab. One benefit of the invention is that it can be easily applied to the poured slab and removed once the adjacent slab has been completed. These and other objects and benefits of the invention can be discerned from the following written description taken together with the accompanying figures.

DESCRIPTION OF THE PREFERRED EMBODIMENTS

Figure 1:
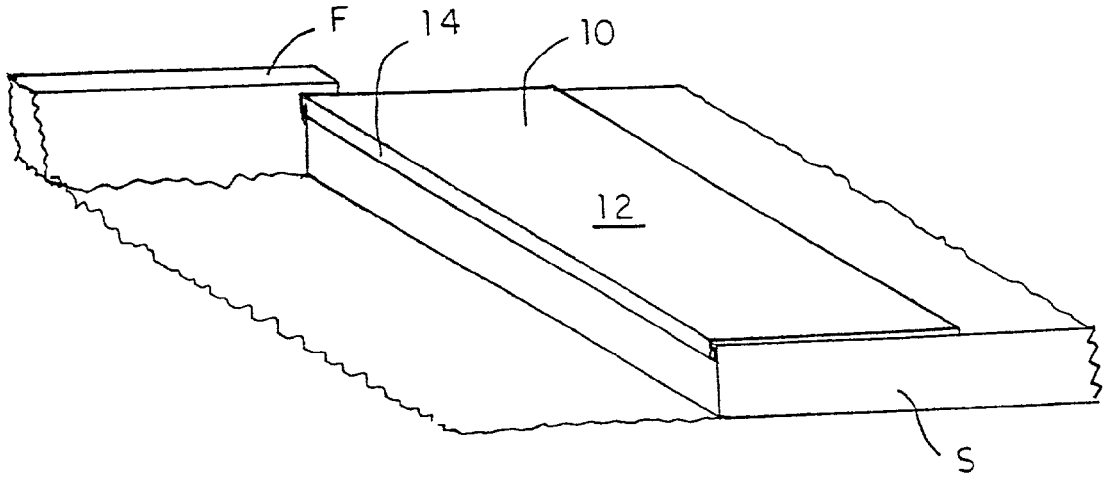
FIG. 1 is a perspective view of a poured slab prior to pouring of an adjacent slab, with the slab protector of the present invention mounted on the poured slab.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

The present invention provides a slab protector 10 configured to cover a portion of a recently poured slab S, as depicted in FIG. 1. A temporary form F is shown in the figure to indicate where the adjacent slab is to be poured. In accordance with the invention, the slab protector 10 fits over the exposed side and edge of the poured slab S. More specifically, the protector includes a primary portion 12 that overlies the exposed surface of the slab. The protector 10 also includes an overhang portion 14 that extends over the edge of the slab and down a portion of the exposed side of the slab.

Figure 2:
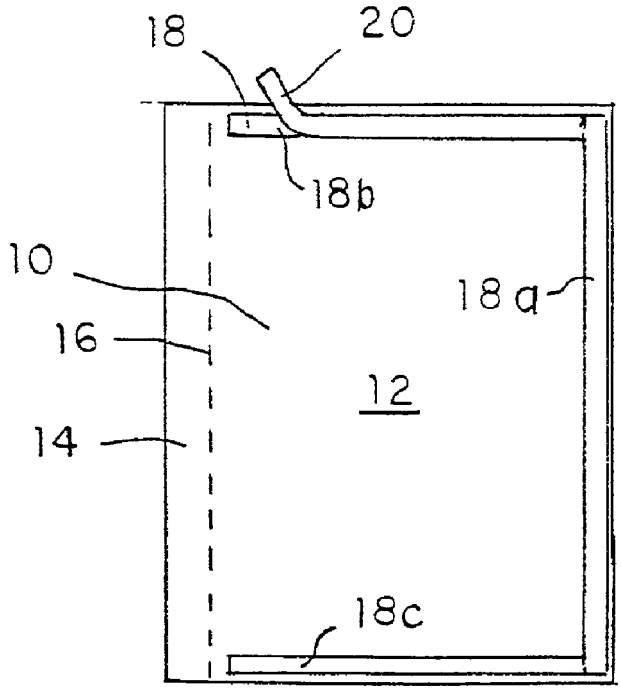
FIG. 2 is a top elevational view of the slab protector according to one embodiment of the invention, prior to mounting on a poured slab.

In accordance with the invention, the slab protector 10 is formed of a material that resists tearing or puncture when struck by a concrete finishing tool, such as a trowel. Preferably, the material is a plastic material, such as polypropylene or polyurethane. Most preferably, the material is flexible so that the slab protector can be provided in sheet form, such as shown in FIG. 2. The sheet can be provided with a score or a fold line 16 delineating the primary portion 12 and the overhang portion 14. The sheet can be initially provided flat, as shown in the figures, and then folded along the fold line 16 when the protector 10 is placed over a slab S. The fold line 16 can be a line of reduced thickness relative to the rest of the sheet to facilitate folding along the line. Alternatively, the sheet material can be susceptible to being folded anywhere without the need for a score or fold line. It is important that the sheet be able to be folded so that the overhang portion 14 can rest flush against the side of the slab S so that the slab protector 10 will not interfere with the adjacent pour.

Alternatively, the slab protector can be produced with the bend pre-formed in the sheet. Specifically, with this alternative, the material must be sufficiently rigid to hold the substantially right angle between the primary portion 12 and the overhang portion 14. With this approach, the slab protector 10 can be easily dropped onto the slab and positioned so that the generally rigid overhang portion 14 abuts the side of the slab.

In the preferred embodiment, the slab protector is dimensioned to adequately cover and protect the region of the slab that is susceptible to damage. The width of the sheet is sufficient to span the width of the slab, which can typically range from three to twelve feet. Alternatively, the slab protector can be provided in pre-determined incremental widths, such as four feet, with the understanding that two or three such sheets might be required to span the width of a concrete slab.

While the length of the slab protector 10 can be sized to cover an entire slab, the larger size is typically unnecessary, since the primary concern is with the concrete pouring and finishing process occurring right next to the slab to be protected. Thus, in a specific embodiment, the primary portion 12 extends between one to two feet across the surface of the slab from its edge. This distance is sufficient to protect against the normal incursions that might be expected from typical concrete finishing equipment. The overhang portion 14 preferably extends across about half the thickness of the slab. Thus, for a standard four-inch pour for a sidewalk or driveway, the overhang portion has a length of about two inches. In a specific embodiment, the slab protector sheet can have a thickness of about ¼ inch, depending upon the material used.

Since the overhang portion 14 may be in direct contact with the concrete as it is poured in the adjacent slab location, the material of the slab protector 10 should be such that the newly poured concrete does not adhere to the overhang portion. Once the adjacent slab has been poured and finished, the protector 10 can be removed. Preferably, the protector is removed after the concrete in the adjacent slab has cured somewhat to minimize the chance that the overhang portion might disrupt the new slab surface or edge. Alternatively, the slab protector 10 can be left in place until the control joints are cut with a concrete saw. In this case, the control joints can be cut at the location of the overhang portion 14, which provides simplifies removal of the protector and allows the slab protector to protect the concrete during the joint cutting operation.

A further feature of certain embodiments of the invention is the provision of some means for temporarily holding the slab protector 10 in position on the slab S. In a preferred embodiment, this means can include an adhesive material on the underside of the slab protector sheet. The adhesive can be provided throughout the entirety of the slab protector sheet 10; however, in accordance with the preferred embodiment the adhesive is in the form of an adhesive strip 18 extending around a portion of the outer perimeter of the primary portion 12. It is preferable that no adhesive be provided on or adjacent to the overhang portion 14, since the adherence may make removal of the overhang portion more difficult. The adhesive strip 18 is formed of an adhesive material that can be readily removed from the concrete, but that has enough adherent properties to hold the slab protector 10 in position when being buffeted by wind or briefly contacted by a surface-finishing tool.

The adhesive material must be capable of substantially permanent adherence to the slab protector sheet material, while capable of tacky, removable adherence to the concrete slab. Examples of such adhesive material include a silicone rubber resin, a low tack polyurethane or a low tack epoxy resin composition. Most preferably, the adhesive strip 18 is protected initially by a cover strip 20 overlaying the adhesive. The cover strip 20 can be easily removed, exposing the adhesive strip 18 when it is desired to use the slab protector 10. The slab protector can then be laid onto the slab and mild pressure applied to the perimeter of the sheet to tack the adhesive material to the concrete of the slab. While it is preferable that each slab protector be used once, it is contemplated that the adhesive may be sufficiently durable to withstand reuse.

In one embodiment, the adhesive strip 18 includes three segments 18*a-c,* with segment 18*a* extending along the width of the slab protector sheet. The segments 18*b-c* extend along the side edges of the sheet, terminating short of the fold line 16. In alternative embodiments, the side segments 18*b-c* can be eliminated, the remaining segment 18*a* being sufficient to hold the slab protector 10 down on the slab under most conditions.

Figure 3:
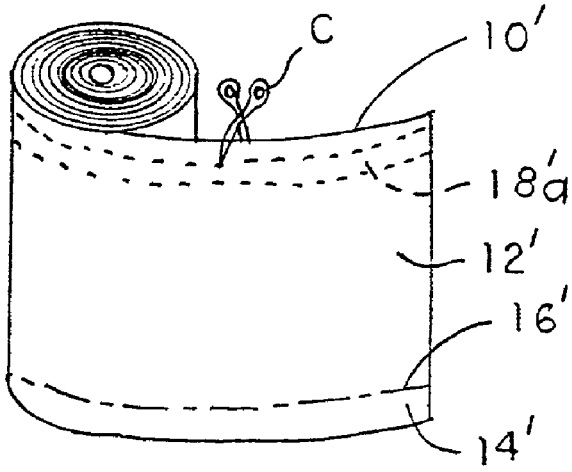
FIG. 3 is a perspective view of a roll of slab protector sheet according to one embodiment of the invention.

In one preferred embodiment, the slab protector 10 is provided as a discrete sheet, such as depicted in FIG. 2. In an alternative embodiment, as illustrated in FIG. 3, the slab protector 10' can be provided on a roll. A desired length of the sheet can be unrolled and cut with shears C to fit the width of the slab S. Optionally, the roll can be provided with vertical tear lines across the width of the sheet to facilitate separating predetermined lengths of sheets, in the manner of paper towels. Preferably, the slab protector sheet 10' is provided with a fold line 16' separating the primary portion 12' from the overhang portion 14'. Since the sheet is provided on a continuous roll, only the adhesive segment 18*a'* need be provided along the length of the sheet roll.

The slab protector 10 provides a simple, but effective, means for protecting a newly poured slab. The protector sheet can be easily reused, whether or not the sheet includes the adhesive strip 18. Where the sheet is flexible, it can be easily rolled and unrolled as needed. A rigid embodiment can be conveniently stored without taking up much space.

The preferred embodiment contemplates a slab protector formed of a continuous sheet of material, most preferably a plastic material. The invention also contemplates other forms for the slab protector, such as a mesh. A mesh configuration can reduce the amount of material required for each protector. The protective function of a mesh slab protector 10 will not be significantly compromised if the mesh openings are small enough to prevent incursion by a concrete finishing tool. For instance, mesh openings of about one inch, or a mesh density on the order of 36 holes per square foot can be acceptable.

Openings in the overhang portion 14 are not desirable since the openings can provide anchor points for concrete poured to form the adjacent slab.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

For instance, the present disclosure has focused upon protecting poured concrete slabs. However, the inventive slab protector can be used to protect other poured materials and slab constructions where successive and adjacent pours and surface finishing operations occur. It should be understood that different slab materials and different surface finishing operations may require modifications in material and dimensions for the slab protector.

What is claimed is:

1. A device for protecting at least a portion of a poured slab during activity at a site adjacent the poured slab, said device comprising a sheet including:

a primary portion sized to extend substantially along the entire width of the slab and to cover a portion of the upper surface of the slab adjacent an exposed side of the slab;

an overhang portion sized to cover a portion of the side of the slab;

a fold portion connecting said primary portion to said overhang portion at an angle configured so that said overhang portion substantially abuts the side of the slab when said primary portion is resting on the surface of the slab; and means for temporarily adhering at least a portion of said primary portion to the slab.

2. The device for protecting a poured slab according to claim 1, wherein said sheet is formed of a flexible material to permit rolling the sheet.

3. The device for protecting a poured slab according to claim 2, wherein said fold portion includes a fold line formed in said sheet to facilitate folding said sheet at said fold portion.

4. The device for protecting a poured slab according to claim 1, wherein said fold portion is formed of a substantially rigid material so that said fold portion maintains said angle when said sheet is not supported on the slab.

5. The device for protecting a poured slab according to claim 1, wherein said means for temporarily adhering includes an adhesive strip on said primary portion.

6. The device for protecting a poured slab according to claim 5, wherein said adhesive strip extends around a portion of the perimeter of said primary portion.

7. The device for protecting a poured slab according to claim 5, wherein said adhesive strip extends only along an edge of said primary portion opposite said fold portion.

8. The device for protecting a poured slab according to claim 5, wherein said means for temporarily adhering includes a removable cover at least initially covering said adhesive strip.

9. A method for protecting at least a portion of a poured slab during activity at a site adjacent the poured slab, said method comprising the steps of:

providing a sheet sized to extend substantially along the entire width of the slab at an exposed side thereof;

disposing an overhang portion of the sheet over the edge of the slab and abutting a portion of the exposed side, with a primary portion of the sheet covering a portion of the upper surface of the poured slab adjacent the exposed side; and maintaining the sheet on the slab during the activity at the site adjacent the slab.

10. The method according to claim 9 wherein:

the providing step includes providing a sheet having a fold line pre-formed in the sheet; and the disposing step includes folding the sheet at the fold line.

11. The method according to claim 9 wherein the providing step includes providing a sheet having a substantially rigid fold between the overhang portion and the primary portion.

12. The method according to claim 9 further comprising the steps of:

removably adhering the primary portion of the sheet to the upper surface of the slab; and removing the sheet from the slab after the activity at the adjacent site has ended.

13. The method according to claim 9 wherein the providing step includes providing the sheet on a roll, unrolling the sheet and cutting the sheet from the roll.

* * * * *